US006367206B1

(12) United States Patent
Silberman et al.

(10) Patent No.: US 6,367,206 B1
(45) **Date of Patent: *Apr. 9, 2002**

(54) RETRACTABLE STADIUM ROOFS AND TRANSPORT MECHANISM THEREFOR

(75) Inventors: Cyril J. Silberman, Minnetonka; M. David Sadinsky, Minneapolis; Barton L. Riberich, Brooklyn Park; Cheuk A. Cheng, New Brighton; Dick Eide, Minneapolis; Lennart Nielsen, Edina, all of MN (US)

(73) Assignee: Uni-Systems, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/609,727

(22) Filed: Jul. 3, 2000

Related U.S. Application Data

(63) Continuation of application No. 09/140,718, filed on Aug. 27, 1998, now Pat. No. 6,082,054.

(51) Int. Cl.[7] ..... E04B 7/16

(52) U.S. Cl. ..... 52/66; 52/6; 52/64

(58) Field of Search ..... 52/64, 66, 67, 52/6

(56) References Cited

U.S. PATENT DOCUMENTS

| | | | | |
|---|---|---|---|---|
| 2,052,217 A | * | 8/1936 | Sibour et al. | 52/64 X |
| 2,603,171 A | * | 7/1952 | Smith | 52/66 |
| 2,642,162 A | | 6/1953 | Tobias | |
| 3,009,211 A | | 11/1961 | Hansen et al. | |
| 3,213,571 A | | 10/1965 | Olson | |
| 3,288,158 A | | 11/1966 | Gugliotta | |
| 3,534,511 A | | 10/1970 | Cappella | |
| 3,608,252 A | | 9/1971 | Bisson | |
| 3,766,691 A | | 10/1973 | Ray | |
| 4,175,361 A | | 11/1979 | Kumode | |
| 4,257,199 A | | 3/1981 | Kuboyama | |

(List continued on next page.)

FOREIGN PATENT DOCUMENTS

| | | |
|---|---|---|
| JP | 2-217539 A | 8/1990 |
| JP | 2-269237 A | 11/1990 |
| JP | 3-87434 A | 4/1991 |
| JP | 3-115632 A | 5/1991 |
| JP | 4-323446 A | 11/1992 |
| NL | 8006712 | 7/1982 |

*Primary Examiner*—Beth A. Stephan
*Assistant Examiner*—Brian E. Glessner
(74) *Attorney, Agent, or Firm*—Knoble & Yoshida, LLC

(57) ABSTRACT

A stadium that is adapted for open use during good weather as well as for covered use during poor weather includes a foundation and a pair of movable end roof members that are movable between first, retracted positions and second, operational positions for covering first and second end areas, respectively, of the stadium. The stadium also includes a center roof member that is movable between a retracted position and an operational position for covering a center area of the stadium. All of the roof members are supported for movement between the retracted positions and the operational positions by a guide and support assembly that includes at least one rail member that is secured to the foundation and a plurality of independently suspended follower assemblies that are mounted to the respective roof member. Each of said follower assemblies include a wheel member that is positioned in contact with the rail and a resilient member that is interposed between the wheel member and the roof member, so that each of the wheel members is independently suspended with respect to the other wheel members. This creates a number of advantages, including that it makes alignment easier to achieve and maintain, and that it allows the guide and support assembly to be constructed with a large number of small wheels and to have a relatively low profile, which makes the system attractive from both an aesthetic and a structural standpoint.

4 Claims, 6 Drawing Sheets

U.S. PATENT DOCUMENTS 4,587,775 A 5/1986 Lewis et al.
4,616,451 A 10/1986 Glick
4,676,033 A * 6/1987 Allen et al. ..... 52/6
4,682,449 A * 7/1987 Berger ..... 52/66
4,706,419 A 11/1987 Adachi et al.
4,716,691 A * 1/1988 Allen et al. ..... 52/6
4,727,688 A * 3/1988 Kida et al. ..... 52/6
4,738,057 A 4/1988 Logan
4,751,800 A * 6/1988 Kida et al. ..... 52/66
4,802,314 A 2/1989 Schildge, Jr.
4,831,792 A * 5/1989 Berger ..... 52/66
4,833,837 A 5/1989 Bonnean
4,920,707 A 5/1990 Moskaliuk et al.
4,936,060 A 6/1990 Gelinas et al.
4,942,698 A 7/1990 Kumagai
4,995,203 A 2/1991 Brisbin et al.
5,007,214 A * 4/1991 Itami et al. ..... 52/66
5,010,695 A 4/1991 Schildge, Jr.
5,027,565 A * 7/1991 Sugizaki ..... 52/6
5,035,093 A 7/1991 Parazader et al.
5,058,332 A 10/1991 Masuyama et al.
5,062,243 A 11/1991 Kumagai
5,063,730 A * 11/1991 Muramoto et al. ..... 52/66
5,103,600 A 4/1992 Geiger et al.
5,117,594 A * 6/1992 Muramoto et al. ..... 52/66
5,167,097 A 12/1992 Robbie et al.
5,167,341 A * 12/1992 Morton et al. ..... 52/66 X
5,203,125 A 4/1993 Sugizaki
5,257,481 A * 11/1993 Reppas et al. ..... 52/66 X
5,257,485 A 11/1993 Kawaguchi et al.
5,355,641 A * 10/1994 Levy ..... 52/66
5,371,983 A 12/1994 Kawaguchi et al.
5,394,660 A * 3/1995 Haris ..... 52/66
5,653,066 A 8/1997 Schildge, Jr.
5,778,603 A 7/1998 Reppas
5,896,708 A * 4/1999 Doi et al. ..... 52/66
5,983,575 A * 11/1999 Reppas ..... 52/66

* cited by examiner

RETRACTABLE STADIUM ROOFS AND TRANSPORT MECHANISM THEREFOR

This is a continuation of Ser. No. 09/140,718, filed Aug. 27, 1998, now U.S. Pat. No. 6,082,054.

BACKGROUND OF THE INVENTION

1. Field of the Invention

This invention pertains, in general, to the field of retractable covers or roofs for large structures, such as athletic stadiums. More specifically, the invention relates to an improved transport mechanism for such a structure that is more compact, reliable, stable, mechanically simple and inexpensive to construct than comparable mechanisms heretofore known.

2. Description of the Related Technology

It is common these days for athletic stadiums to be constructed with retractable roofs, because this type of construction offers spectators the pleasure of being outdoors on nice days, while providing shelter when necessary against extreme temperatures and inclement weather conditions.

A number of factors must be taken into account in the design of a stadium that has a retractable roof. For instance, the forces created by the exertion of natural forces such as wind, rain snow and even earthquakes on such a large structure can be enormous, and the roof, the underlying stadium structure and the transport mechanism that is used to guide and move the roof between its retracted and operational positions must be engineered to withstand the worst possible confluence of such forces. In addition, for reasons that are both aesthetic and practical, it is desirable to make the structural elements of the roof and the transport mechanism to be as unobtrusive and as space-efficient as possible. It is desirable to make the roof structure and the transport mechanism to be as simple and maintenance-free as possible, and to be constructed so as to be able to open and close as quickly as possible.

Many cities in the United States and elsewhere are now using or building retractable proofed stadiums. The designs of the various stadiums are quite different, but there are a number of deficiencies that seem to be common to all of the designs that have been implemented thus far. For example, the transport mechanisms in most of the stadiums tend to be quite large, being as much as twenty to thirty feet in height. The transport mechanisms further tend to include a relatively small number of very large, heavily loaded wheels and bearings, and a small number of very large motors or actuators to drive the roof between the retracted and operational positions. The small number of large wheels exert very large concentrated loads onto the support structure, which requires the support structure to be heavily reinforced, adding to the cost and complexity of the stadium as a whole. The roof and transport mechanisms in existing designs further tend to be relatively heavy and inflexible, and often experience alignment problems during movement.

A need exists for an improved design for a stadium that has a retractable roof that is more compact, reliable, stable, mechanically simple and inexpensive to construct than comparable mechanisms heretofore known.

SUMMARY OF THE INVENTION

Accordingly, it is an object of the invention to provide an improved design for a stadium that has a retractable roof that is more compact, reliable, stable, mechanically simple and inexpensive to construct than comparable mechanisms heretofore known.

In order to achieve the above and other objects of the invention, a convertible large edifice, such as an athletic stadium, of the type that is equipped with a movable overhead shelter mechanism, includes, according to a first aspect of the invention, foundation structure; at least one overhead shelter assembly positioned above the foundation shelter; and guide and support means for supporting the overhead shelter assembly and guiding the overhead shelter assembly for movement with respect to the foundation structure, the guide and support means including at least one rail member that is secured to one of the foundation structure and the overhead shelter assembly; a plurality of independently suspended follower assemblies that are mounted to the other of the foundation structure and the overhead shelter assembly, each of the follower assemblies including a wheel member that is positioned in contact with the rail, and a resilient member that is interposed between the wheel member and the other of the foundation structure and the overhead shelter assembly whereby each of the wheel members is independently suspended with respect to the other wheel members.

According to a second aspect of the invention, a stadium that is adapted for open use during good weather as well as for covered use during poor weather includes foundation structure; a pair of movable end roof members that are movable between first, retracted positions and second, operational positions for covering first and second end areas, respectively, of the stadium; and a center roof member that is movable between a retracted position and an operational position for covering a center area of the stadium; and wherein at least one of the center roof member and the two end roof members are supported for movement between one of the retracted positions and one of the operational positions by a guide and support means that includes at least one rail member that is secured to the foundation structure; and a plurality of independently suspended follower assemblies that are mounted to the respective roof member, each of the follower assemblies including a wheel member that is positioned in contact with the rail, and a resilient member that is interposed between the wheel member and the other of the foundation structure and the overhead shelter assembly, whereby each of the wheel members is independently suspended with respect to the other wheel members.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
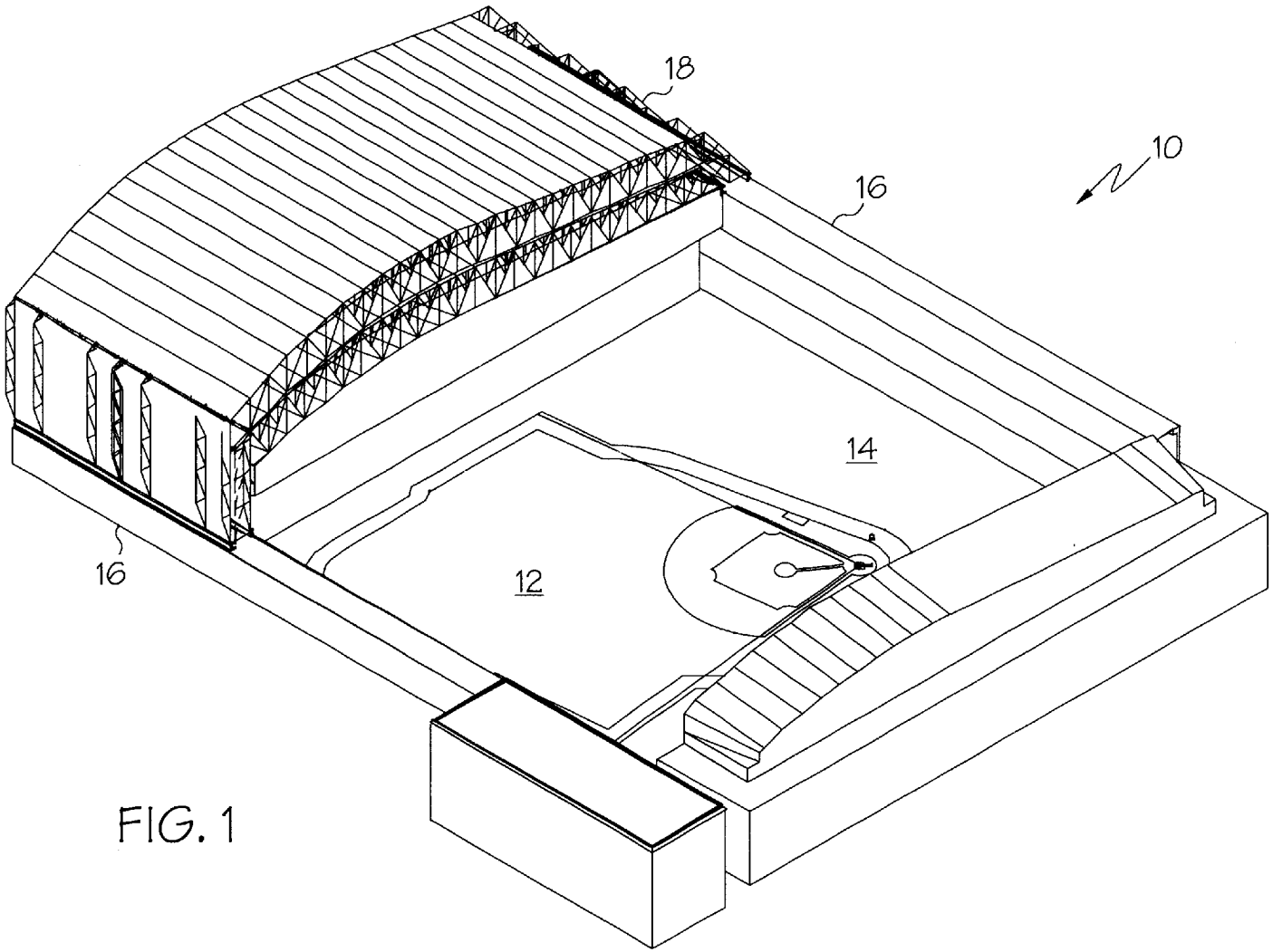
FIG. 1 is a perspective view of a system that is constructed according to a first preferred embodiment of the invention, shown in a first, retracted position.
Figure 2:
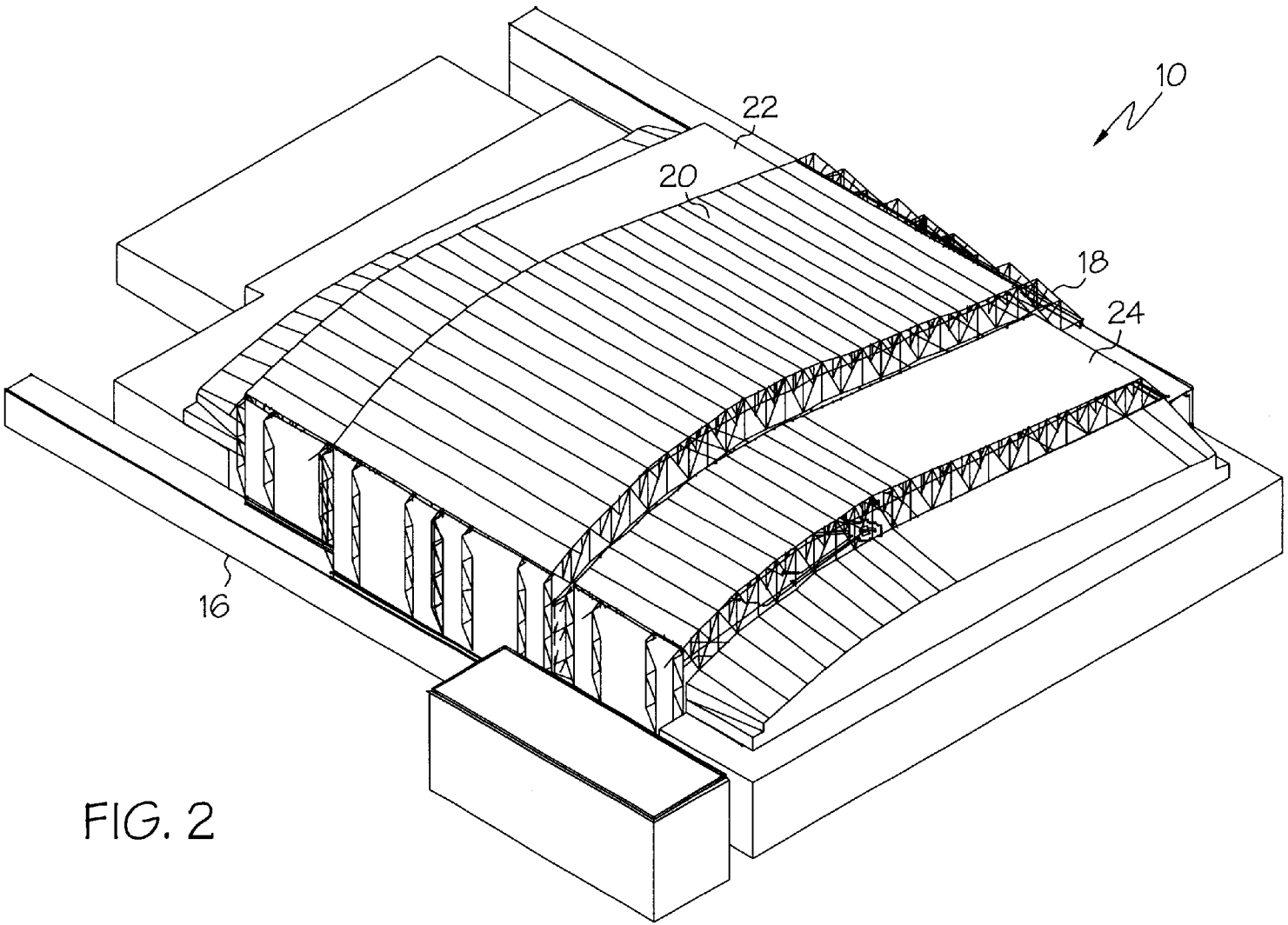
FIG. 2 is a perspective view of the system shown in FIG. 1, shown in a second, operational position.

Referring now to the drawings, wherein like reference numerals designate corresponding structure throughout the views, and referring in particular to FIGS. 1 and 2, an athletic stadium 10 that is adapted for open use during good weather as well as for covered use during poor weather includes a playing field 12, a spectator seating area 14, and a foundation 16. Stadium 10 further includes a roof assembly 18 that is made up of a center roof member 20 that is movable between a retracted position and an operational position for covering the center of the stadium 10, and first and second end roof members 22, 24 that are supported for movement between a retracted positions and operational positions for covering first and second end areas, respectively, of the stadium 10.

Figure 3:
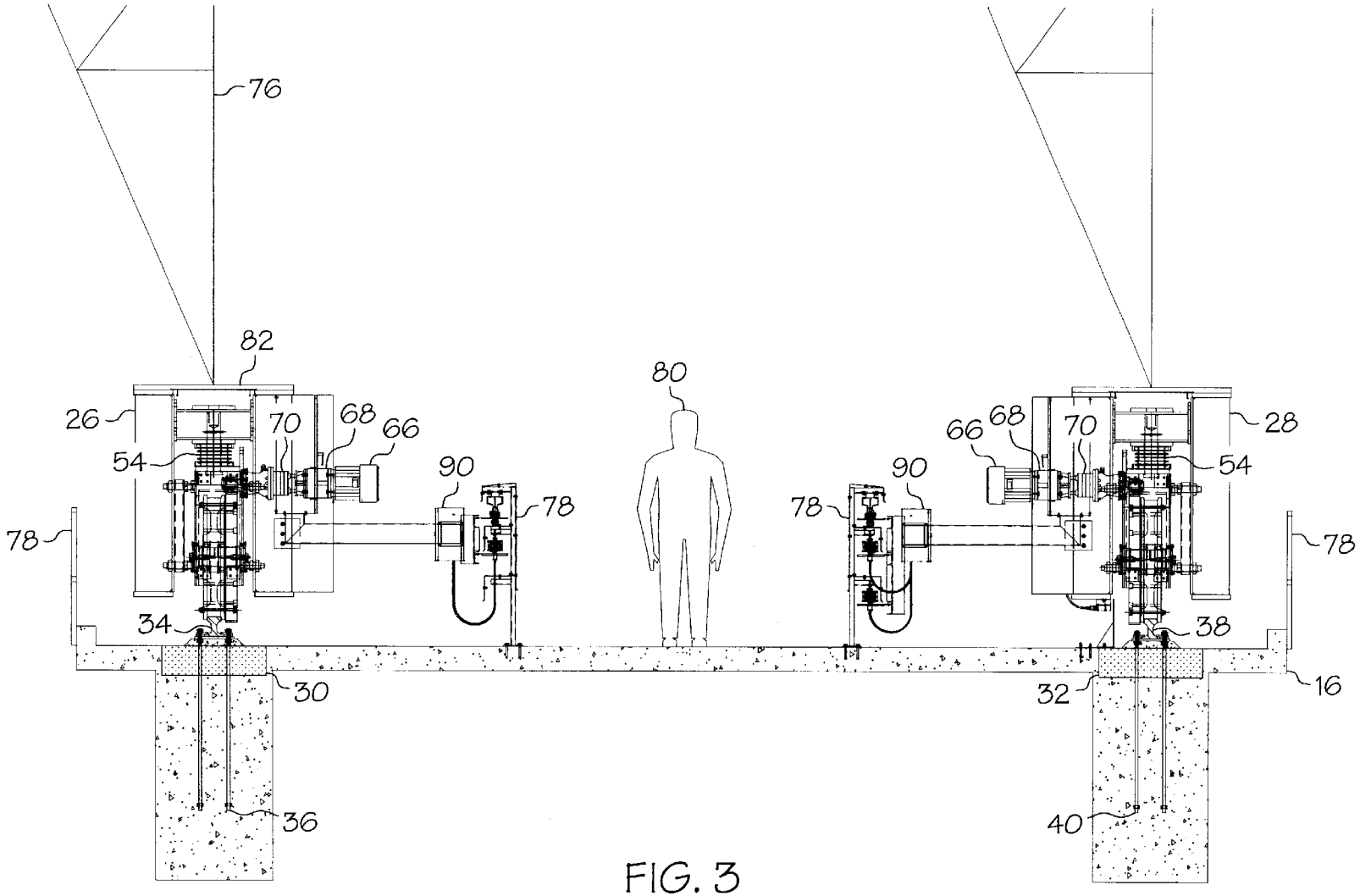
FIG. 3 is a diagrammatical cross-sectional view depicting a transport mechanism for the system shown in FIG. 1.

Referring now to FIG. 3, which is a cross sectional diagrammatical depiction of a transport mechanism that is constructed according to a preferred embodiment of the invention, it will be seen that the transport mechanism includes a first guide and support system 26 for guiding and supporting one side of the center roof member 20 during operation and a similar, second guide and support system 28 for likewise guiding one side of the first and second and roof members 22, 24. The first guide and support system 26 is positioned on top of a support surface 30 that is defined in the foundation 16 of the stadium 10, while the second guide and support system 28 is similarly positioned on top of a support surface 32 that is defined on foundation 16. As may be seen in FIGS. 3 and 4, the first and second guide and support systems 26, 28 include, respectively, first and second rail members 34, 38 that are secured to the respective support surfaces 30, 32 by means of anchor members 36, 40, which are of conventional construction.

Figure 4:
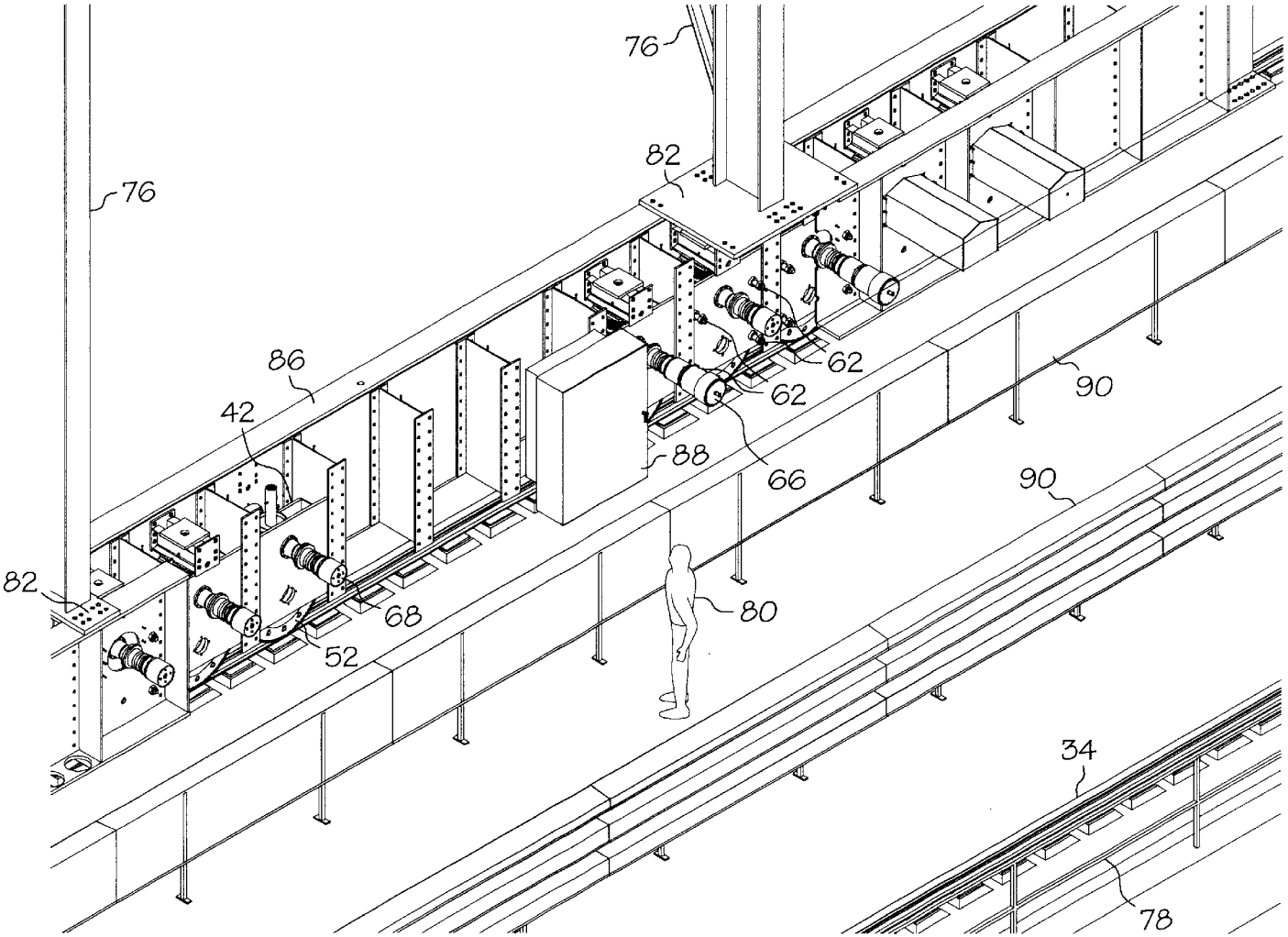
FIG. 4 is a perspective view depicting the transport mechanism shown in FIG. 3.

As may best be seen in FIG. 4, each of the guide and support systems 26, 28 is provided with a plurality of independently suspended follower assemblies 42 that are mounted to the corresponding roof member 20, 22, 24 and which each include a steel wheel 52 that is positioned in contact with the respective rail 34, 38. For purposes of simplicity, the guide and support systems 26, 28 will from this point on be described with reference to the first guide and support system 26, it being clear that the second guide and support system 28 is substantially identical in construction to the first.

Figure 5:
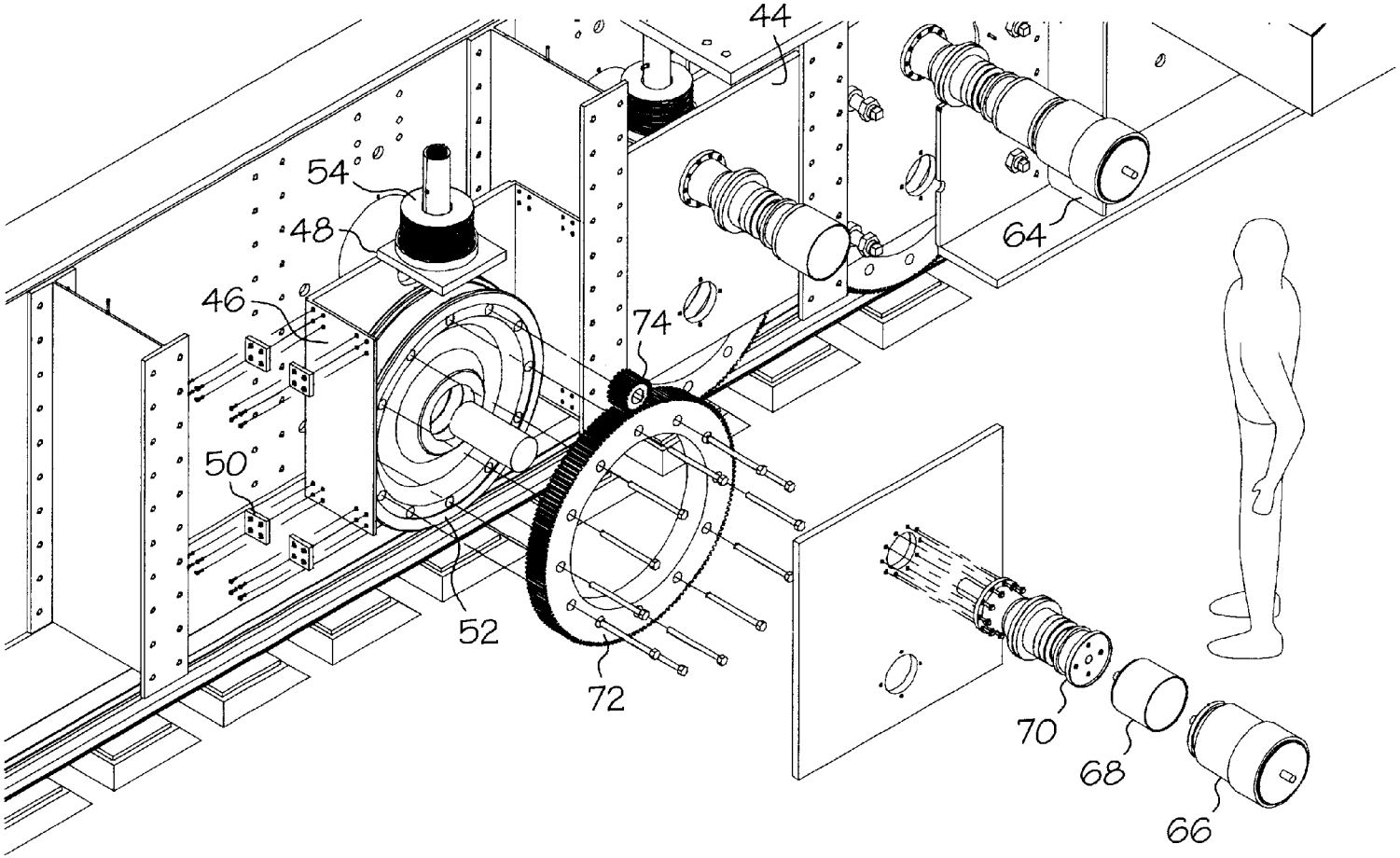
FIG. 5 is an exploded perspective view depicting the transport mechanism shown in FIG. 3.
Figure 6:
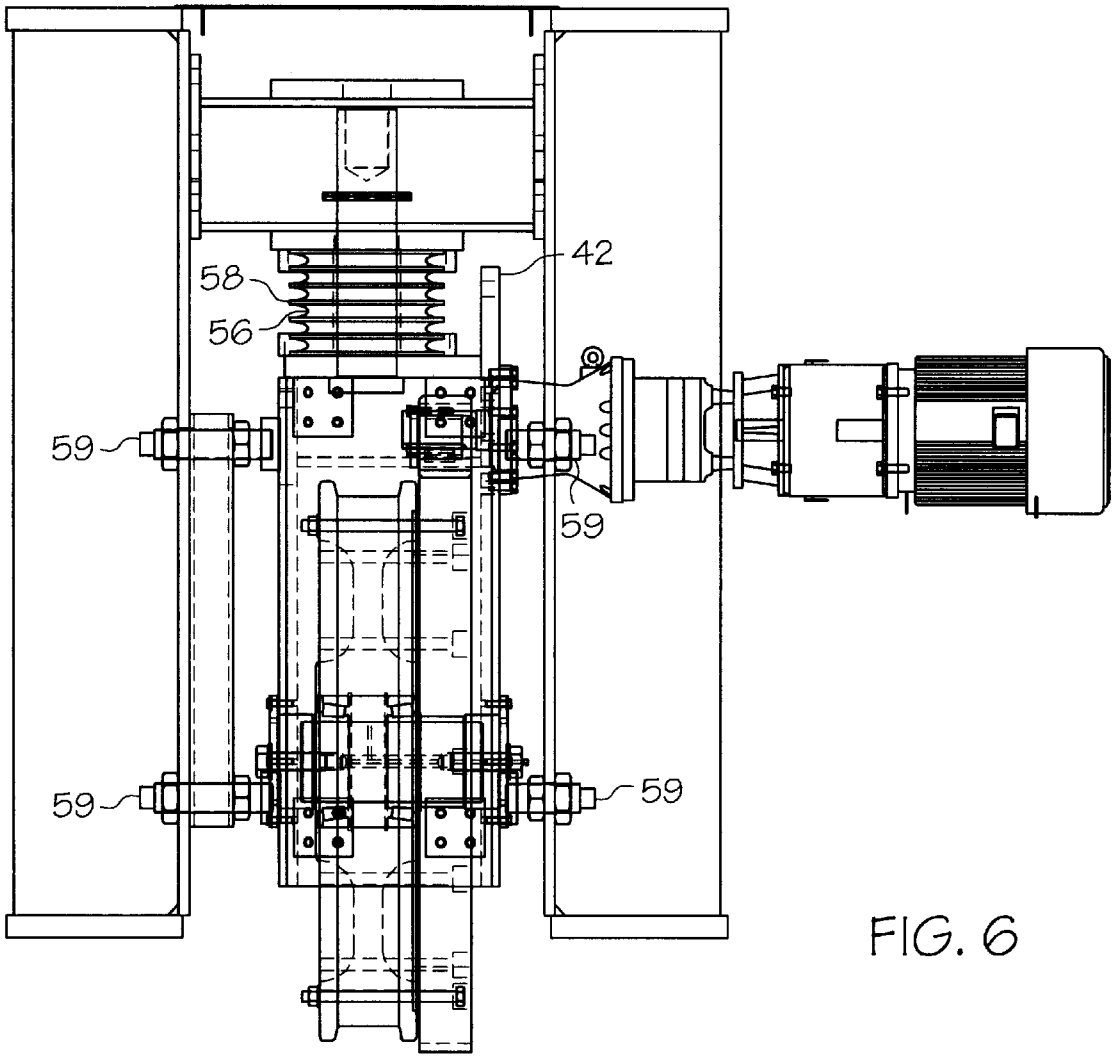
FIG. 6 is a cross-sectional view depicting one component system of the transport mechanism shown in FIG. 3.

As may best be seen in FIGS. 4 and 6, each of the follower assemblies 42 is constructed as having a frame 44 that is made up of a pair of side walls 46 and a top wall 48. The frame 44 of each follower assembly is designed to float within the space that is defined by a pair of guide plates 62, as may be seen in FIG. 4. In other words, the follower assemblies 42 are free to move vertically with respect to the transport mechanism and the rail 34. As can also be seen in FIG. 5, a number of bearing plates 50 are secured to the side walls 46 of the frame 44 to ease any friction that might otherwise develop between the respective frames 44 on the follower assemblies 42 and the guide plates 62 of the transport mechanism. In addition to the bearing plates, the follower assemblies are guided by the follower assembly alignment screws 59 in the direction that is perpendicular to the rail. These alignment screws 59 provide easy wheel alignment as well as support for lateral load transfer. The combination of the bearing plates and alignment screws provides a positive system for transferring all lateral loads from the roof structure to the follower assemblies and wheels.

One important aspect of the guide and support systems 26, 28 is the provision of an independent suspension system 54 for each of the follower assemblies 42. Referring back to FIG. 3, it will be seen that each of the follower assemblies 42 is limited in its upward movement by a resilient member 56 that is, as may better be seen in FIG. 6, made up all of a plurality of elastomeric disk members 58 and a corresponding plurality of metal plates that are provided between the respective disk members 58. The provision of an independent suspension system for each of the follower assemblies 42 provided an inexpensive, dependable system for distributing roof loads over a relatively large number of wheels. Thus the wheel loads are smaller and the roof loads are distributed over a larger area of the supporting structure. This results in a construction cost savings for the supporting structure. Although the same advantages could be attained by use of a large, more sophisticated system that incorporates load leveling beams and the like, such a system would be larger, heavier and more expensive. Another advantage of the independent suspension systems that are provided for each of the follower assemblies 42 is that they tend to vibrationally isolate the roof structure from the supporting foundation.

Referring again to FIGS. 4 and 6, it will be seen next several of the follower assemblies are provided with a drive and transmission assembly 64 that includes an electric motor 66, an electric brake 68, a reduction gear box 70, a bull gear 72, and a pinion gear 74. As may be seen in FIG. 5, the electric motor 66 and the electric break 68 are both constructed and arranged to act on a drive shaft that leads into the reduction gear box 70. An output shaft of the reduction gear box 70 is connected to the pinion gear 74, which in turn engages the bull gear 72. The bull gear 72 is secured to rotate the steel wheels 52 that ride upon the rail 34 in the manner that has been described below. Power is supplied to the electric motor 66 and the electric brake 68 by means of a power bus bar 90, viewable in FIG. 3. Since a relatively large number of follower assemblies are provided with a drive and transmission assembly, the individual drive components can be of a modest size. This modest size allows components to be common, readily available parts that can be easily handled and replaced. Also, the large number of modestly sized drive components provides mechanical redundancy and reliability. For example, if a few of the drive components fail, the large number of remaining operational drives can continue to drive the roof until it is convenient to service the failed components.

As may be seen in FIG. 4, although several of the follower assemblies 42 are provided with electric motors 66, several other of the follower assemblies 42 are not so provided. However, all of the follower assemblies 42 are provided with the electric brake mechanisms 68 and the other mechanical details that are depicted in FIG. 5, such as the reduction gearing. Since all of the follower assemblies are provided with reduction gearing and brakes, a tremendous amount of lateral load can be transferred from the roof to its supporting foundation through wheel traction.

As can also be seen in FIGS. 3, 4 and 6, a number of guard rails 78 are provided one each side of the respective guide and support systems 26, 28 for the protection of the operator 80 and other personnel that may have occasion to approach the transport mechanism.

As will be evident from viewing the structure of the transport mechanism as has been shown in FIGS. 4–6, the construction and shaping of the transport mechanism as a whole will impart significant rigidity and resistance against bending along the axis of the respective guide and support systems 26. The guide and support system 26 shown in FIG. 4 is connected to the center roof member 20 by means of a bowstring-type truss 76 that is secured to a pair of longitudinal top cover beams 86, of the transport mechanism by means of a number of foot plates 82. The fact that the transport mechanism can act as an integral part of these structural framework of the roof assembly 18, despite its low profile and small size, is one of the significant advantages of the invention.

The transport mechanism is controlled by a sophisticated system of sensors, controls, computers, and operator interfaces. The travel speed and position are monitored and controlled by a network of sensors and computer logic.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A convertible large edifice, such as an athletic stadium, of the type that is equipped with a movable overhead shelter mechanism, comprising:

foundation structure;

at least one overhead shelter assembly positioned above said foundation structure; and guide and support means for supporting said overhead shelter assembly and guiding said overhead shelter assembly for movement with respect to said foundation structure, said guide and support means comprising:

at least one rail member that is secured to one of said foundation structure and said overhead shelter assembly;

a plurality of follower assemblies that are mounted to the other of said foundation structure and said overhead shelter assembly, each of said follower assemblies including a wheel member that is positioned in contact with said rail, and a resilient member that is interposed between said wheel member and said other of said foundation structure and said overhead shelter assembly, said resilient member comprising a plurality of elastomeric members and a plurality of separator plates that are positioned between the respective elastomeric members.

2. An edifice according to claim 1, wherein said elastomeric members are disc-shaped.

3. An edifice according to claim 1, wherein said separator plates are metal.

4. An edifice according to claim 1, wherein said separator plates are metal.

* * * * *